US009356383B2

(12) United States Patent
Waffenschmidt et al.

(10) Patent No.: US 9,356,383 B2
(45) Date of Patent: May 31, 2016

(54) TRANSMITTER MODULE FOR USE IN A MODULAR POWER TRANSMITTING SYSTEM

(75) Inventors: Eberhard Waffenschmidt, Aachen (DE); Rafael Roehrlich, Aachen (DE); Michael Deckers, Aachen (DE); Dries Van Wageningen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 592 days.

(21) Appl. No.: 13/700,172

(22) PCT Filed: May 9, 2011

(86) PCT No.: PCT/IB2011/052030

§ 371 (c)(1),
(2), (4) Date: Nov. 27, 2012

(87) PCT Pub. No.: WO2011/148289

PCT Pub. Date: Dec. 1, 2011

(65) Prior Publication Data

US 2013/0069444 A1 Mar. 21, 2013

(30) Foreign Application Priority Data

May 28, 2010 (EP) ..... 10164222

(51) Int. Cl.
*H01F 27/00* (2006.01)
*H01R 13/514* (2006.01)
(Continued)

(52) U.S. Cl.
CPC ..... *H01R 13/514* (2013.01); *H01F 38/14* (2013.01); *H01F 27/2804* (2013.01)

(58) Field of Classification Search
CPC ..... H02J 5/005
USPC ..... 307/104
See application file for complete search history.

(56) References Cited

U.S. PATENT DOCUMENTS 6,517,372 B1 2/2003 Jones
6,906,495 B2 6/2005 Cheng
(Continued)

FOREIGN PATENT DOCUMENTS

CN 2543239 Y 4/2003
EP 1283663 A2 2/2003
(Continued)

OTHER PUBLICATIONS

Ryuichi Kurakake et al., "Magic Surfaces: A Smart Building Material for Indoor Sensing Infrastructures", Networked Sensing Systems, 2007. INSS '07. Fourth International C onference on, IEEE, PI, Jun. 1, 2007, pp. 213-220, XP031131594.
(Continued)

*Primary Examiner* — Stephen W Jackson
(74) *Attorney, Agent, or Firm* — Larry Liberchuk

(57) ABSTRACT

A modular power transmitting system comprises multiple transmitter modules being connected together for transmitting power inductively to a receiver. The transmitter module is connected with other transmitter modules for transmitting power inductively to the receiver, wherein the transmitter module (40) comprises at least one transmitter cell (30), each transmitter cell having one transmitter coil (33) by which the transmitter cell transmitting power to the receiver, the transmitter module having an outer periphery (45) being shaped so as to fit to neighboring transmitter modules for forming an power transmitting surface, the at least one transmitter cell being arranged such that the power transmitting surface is constituted by an uninterrupted pattern of adjacent transmitter coils extending in said surface, and interconnection units (110,111) for connecting with neighboring transmitter modules for sharing a power supply.

16 Claims, 9 Drawing Sheets

(51) Int. Cl.
*H01F 38/14* (2006.01)
*H01F 27/28* (2006.01)

(56) References Cited

U.S. PATENT DOCUMENTS

| | | | | |
|---|---|---|---|---|
| 7,164,255 | B2 * | 1/2007 | Hui | 320/108 |
| 7,262,700 | B2 | 8/2007 | Hsu | |
| 7,576,514 | B2 | 8/2009 | Hui | |
| 8,038,532 | B2 * | 10/2011 | Neervoort et al. | 463/39 |
| 8,633,792 | B2 | 1/2014 | Willemsen | |
| 8,810,071 | B2 | 8/2014 | Sauerlaender | |
| 2003/0030533 | A1 | 2/2003 | Waffenschmidt | |
| 2009/0096413 | A1 | 4/2009 | Partovi | |

FOREIGN PATENT DOCUMENTS

| | | | |
|---|---|---|---|
| EP | 1575336 | A1 | 9/2005 |
| GB | 2389720 | A | 12/2003 |
| WO | WO2005004560 | A1 | 1/2005 |
| WO | WO2008026080 | A2 | 3/2008 |
| WO | WO2008050260 | A1 | 5/2008 |
| WO | WO2008050292 | A2 | 5/2008 |
| WO | WO2009040807 | A2 | 4/2009 |
| WO | WO2009090108 | A1 | 7/2009 |
| WO | WO2009155030 | A2 | 12/2009 |
| WO | WO2010097725 | A1 | 9/2010 |
| WO | WO2010136927 | A2 | 12/2010 |
| WO | WO2010136928 | A1 | 12/2010 |
| WO | WO2010007300 | A2 | 1/2011 |

OTHER PUBLICATIONS

Hatanaka Koichi et al., "Coil Shape in a Desk-Type Contactless Power Station System", Journal of the Magnetics Society of Japan, vol. 25; No. 4-2; pp. 1015-1018, (2001).

Hatanaka Koichi et al., "Power Transmission of a Desk with a Cord-Free Power Supply", Dept.. of Electrical Engineer, Tohoku Gakuin Univ., Tagajo ;, IEEE Transactions on Magnetics, Sep. 2002, vol. 38, Issue: 5, Part 1 pp. 3329-3331.

J. Murakami et al., "Consideration on Cordless Power Station-Contactless Power Transmission System", IEEE Transactions on Magnetics, vol. 32, Issue 5, Sep. 1996, pp. 5037-5039.

Waffenschmidt E. et al, "Design Method and Material Technologies for Passives in Printed Circuit Board Embedded Circuits", Special Issue on Integrated Power Electronics of the IEEE PELS Transactions, vol. 20, No. 3, May 2005, pp. 576-584.

* cited by examiner

TRANSMITTER MODULE FOR USE IN A MODULAR POWER TRANSMITTING SYSTEM

FIELD OF THE INVENTION

The invention relates to the field of power transmission technology using an inductive wireless power transmission system, more particular, to a transmitter module for use in the inductive power system for transmitting power inductively to a receiver.

The invention further relates to a filler module, and an extension module, for use in the modular inductive power system.

BACKGROUND OF THE INVENTION

To charge the batteries of battery-fed devices, such as cellular phones, PDAs, remote controls, notebooks etc., or directly power devices such as lamps or kitchen appliances, an inductive power system enabling a wireless power transfer can be applied. Inductive power systems for transferring power or charging mobile devices are generally known. Such a system comprises a power transmitting device, hereafter called transmitter module, comprising one or more transmitter coils which can individually be energized, thereby generating an alternating magnetic field. The inductive power system is used for transferring power to a power receiving device, hereafter called receiver, which are connectable to, or part of, a device that is to be charged or provided with power. In order to receive the power, the power receiving device is provided with a receiver coil, in which the alternating magnetic field, provided by the energized transmitter coils, induces a current. This current can drive a load or, for example, charge a battery, power a display or light a lamp.

Document U.S. Pat. No. 7,576,514 describes a planar inductive battery charging system designed to enable electronic devices to be recharged. The system includes a planar power surface on which a device to be recharged is placed. Within the power surface is at least one and preferably an array of transmitter coils that couple energy inductively to a receiver coil formed in the device to be recharged. Various arrangements of transmitter coils are described to provide an uninterrupted power surface having a substantially constant density of transmitter coils. The application of such an array may be a general power surface for powering wireless devices, e.g. for charging batteries, integrated in furniture, or as floor or wall covering.

SUMMARY OF THE INVENTION

The known wireless inductive power system has the problem, that the size of the transmitter area is pre-determined. However, in many cases, the needed area may vary, such that a system with pre-determined size lacks flexibility. By selecting the appropriate number of coils, the transmitter area can be selected to any arbitrary size. However, then the size is fixed and cannot be extended. If two or more of the predetermined size systems are put together, gaps between the systems will remain, because the borders of these systems are not designed to be combined. At these positions, the operation (e.g. power transmission) is not properly provided. Furthermore, the individual systems are not designed to cooperate with each other.

It is an object of the invention to provide a transmitter module for use in a power transmitting system. The transmitter module is intended for being connected with other transmitter module to form the system, which can be easily extended to an arbitrary size while maintaining flexibility.

For this purpose, according to a first aspect of the invention, a transmitter module for use in a modular inductive power system is proposed. The system comprises the transmitter module connected with other transmitter modules for transmitting power inductively to a receiver. Preferably, the other transmitter modules are the same with the transmitter module in terms of shape and coil arrangement. This will simplify the system design. The transmitter module comprises at least one transmitter cell, each transmitter cell having one transmitter coil by which the transmitter cell transmitting power to the receiver, the transmitter module having an outer periphery being shaped so as to fit to neighboring transmitter modules for forming an power transmitting surface, the at least one transmitter cell being arranged such that the power transmitting surface is constituted by an uninterrupted pattern of adjacent transmitter coils extending in said surface, the transmitter module comprising interconnection units for connecting with neighboring transmitter modules adjacent in said directions for sharing a power supply.

The outer shape of the transmitter cell is formed to allow a dense pattern of adjacent transmitter coils when the cells are arranged side by side. For example, the shape of the cell being a regular polygon, e.g. a hexagon or a square, the cells can be adjacent and regularly arranged without any interruption. The outer periphery of the module may constituted by sections of the transmitter cell shape, and therefore allows arranging the modules side by side in any direction enabled by the basic shape of the cell. When a number of modules are so arranged, the transmitter cells and the respective coils constitute an uninterrupted pattern in an area of an arbitrary size. The distances between transmitter coils are always equal, whether the coils are inside the same module or in different modules. With this uninterrupted pattern, the user can put the receiver anywhere of the power transmitting surface. Also, the system can serve a receiver with big receiving coil with better efficiency. The interconnection units conveniently at least provide power supply to all modules arranged side by side.

In an embodiment of transmitter module, it comprises a controller for controlling the power transmission to the receiver, e.g. a switching unit for activating the respective transmitter coils. The controller may enable autarkic operation of each transmitter module, i.e. the controller may provide local intelligence to enable autonomous control of power transmission and/or possible other functions like communication with the receiver. Then, whether or not a neighboring module is present, the module may autonomously control the power transfer to a receiver. The measures have the effect that an inductive power surface is formed that is extendible to an arbitrary size by adding additional modules.

In an embodiment of transmitter module, the transmitter cell, for the part where it constitutes the outer periphery, may be shaped according to a regular polygon, like hexagon, or a regular shape of petal, or any other curve pattern with extrusive parts and concave parts, wherein the extrusive parts fit to the concave parts of the neighboring transmitter modules, and the concave parts fit to the extrusive parts of the neighboring transmitter modules, as long as the outer periphery pattern fits to the outer periphery of neighboring modules and it enables an uninterrupted coils arrangement along the whole power surface. Due to the uninterrupted coils arrangement variations in the inductive field are reduced.

In an embodiment of transmitter module, the outer periphery is further provided with an extending part at a first periphery position and a complementary cut-out part at a second periphery position, and, when the module is arranged in the power surface, the first position being adjacent to the second position of a neighboring module for providing a mechanical fixing via the extending part and the cut-out part. This has the advantage that mechanical stability of the power surface is enhanced.

In an embodiment of transmitter module, the interconnection units, when the module is arranged in the power surface, have a configuration of female connectors for connecting with neighboring transmitter modules via interconnector pins parallel to the power surface. This has the advantage that, at the outer edges of the power surface, no contact pins are extending.

In an embodiment of transmitter module, the interconnection units, when the module is arranged in the power surface, have a electrical configuration of connections arranged along the periphery at a first periphery position for connecting with a complementary connections at a second periphery position at the neighboring transmitter modules, the first and second positions matching when the modules are arranged as intended and not matching when the modules are arranged otherwise, for providing a reverse connection safety. It is to be noted that modules may be symmetric in at least one rotational position. The features have the effect that modules, when properly arranged, will have connection as intended, while positioning a module in a different rotational position result in the interconnection units being at different, non-matching, positions, called reverse connection safety.

In an embodiment of transmitter module, the interconnection units are arranged for providing a communication connection between the transmitter module and the other transmitter modules. This has the effect that the controller is enabled to exchange data among the modules. Advantageously power transfer and other tasks can be coordinated across modules, e.g. when a receiver is positioned across a module boundary.

In an embodiment of transmitter module, the controller is arranged for determining position and orientation of the transmitter module with respect to other transmitter modules arranged in the power surface. Determining of a transmitter module in this document is the function that the module communicates with other modules connected via its interconnection units and detects where and how it is positioned in the power surface with respect to the other modules. Subsequently the module assigns itself to a position and orientation within the power surface. This has the advantage that modules now can respond to commands indicating a specific position in the power surface, e.g. for activating one or more specific receivers.

In an embodiment of transmitter module, the transmitter module comprises a memory for storing identification information for identifying the transmitter module, when the module is arranged in the power surface. The identification information may be stored in a permanent memory, hardwired, or switchable, e.g. set during manufacture or during an installation phase. This has the advantage that the module can be individually addressed.

In an embodiment, a filler module is provided for use in the modular inductive power system as defined above, the filler module having at least one outer periphery part being shaped so as to fit in at least one direction to neighboring transmitter modules forming the power transmitting surface, the outer periphery part, where it is neighboring the transmitter modules, being shaped according to the outer periphery of the neighboring transmitter modules, and at least one further periphery part, the further periphery part, where it is not neighboring the transmitter modules, being straight for proving a straight boundary to the power surface. The filler module advantageously provides, when arranged in the power surface, a straight outer periphery to the power surface.

In an embodiment, an extension module is provided for use in the modular inductive power system as defined above, the extension module having at least one outer periphery part being shaped so as to fit in at least one direction to neighboring transmitter modules forming the power transmitting surface, the outer periphery part, where it is neighboring the transmitter modules, being shaped according to the outer periphery of the neighboring transmitter modules, which extension module comprises interconnection units for providing a power supply to neighboring transmitter modules, or a system controller for controlling power transfer or communication across different transmitter modules; or an operational interface for enabling control of power transfer or communication across different transmitter modules; or an data interface for enabling data transfer or communication across different transmitter modules or the receiver. The extension module advantageously provides, when arranged in the power surface, a shared power supply to the power surface, or a central control unit to enable coordinated functions between transmitter modules, or an operational interface to enable a human user to control the system, or a data interface for enabling data transfer or communication across different transmitter modules or the receiver.

Further preferred embodiments of the device and method according to the invention are given in the appended claims, disclosure of which is incorporated herein by reference.

BRIEF DESCRIPTION OF THE DRAWINGS

These and other aspects of the invention will be apparent from and elucidated further with reference to the embodiments described by way of example in the following description and with reference to the accompanying drawings, in which.

The figures are purely diagrammatic and not drawn to scale. In the Figures, elements which correspond to elements already described have the same reference numerals.

DETAILED DESCRIPTION OF THE EMBODIMENTS

Figure 1:
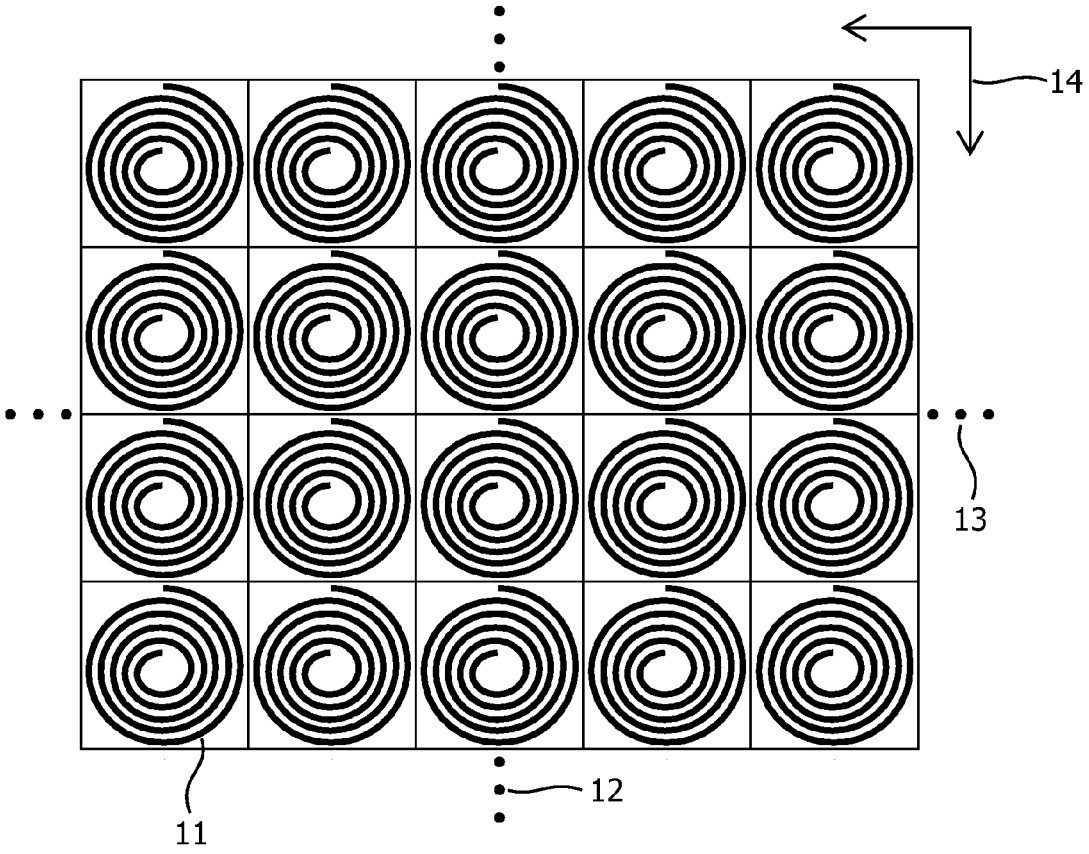
FIG. 1 shows a regular square arrangement of transmitter coils.

FIG. 1 shows a regular square arrangement of transmitter cells. An arrangement of transmitter coils 11 is shown; the coils being positioned in square areas as indicated by drawn lines. The size of the power surface constituted by the coils as indicated by arrow 14 is predetermined, and can be selected by extending the surface in the vertical or horizontal directions as indicated by vertical dots 12 and horizontal dots 13. Various similar arrangements are possible, for example also a triangular arrangement is possible.

Figure 2:
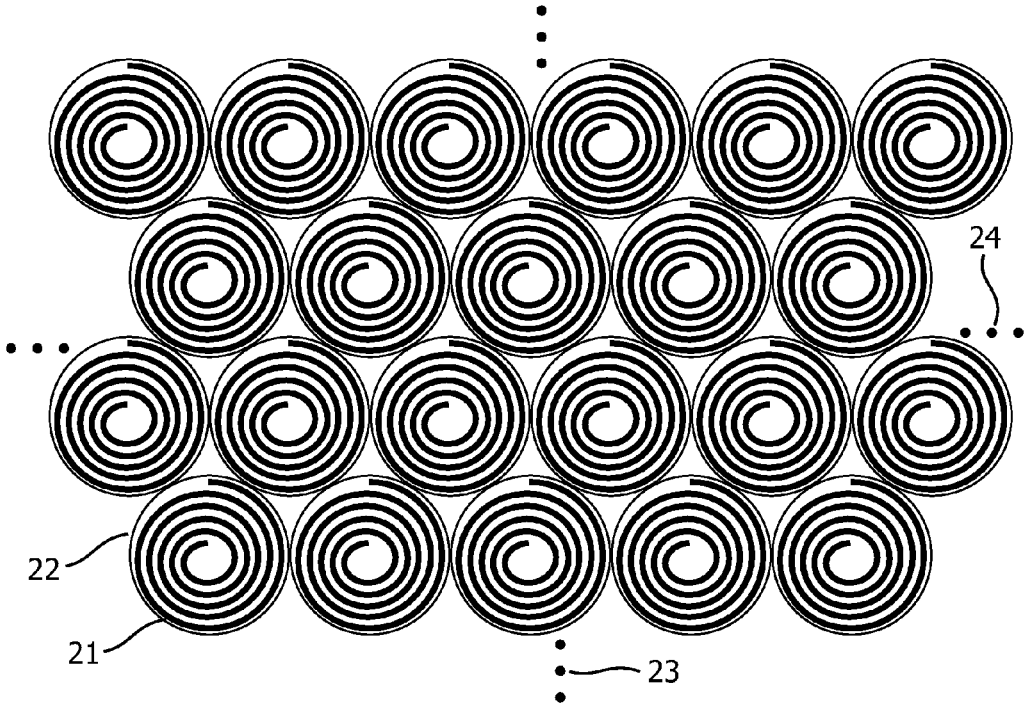
FIG. 2 shows a regular hexagonal arrangement of transmitter coils.

FIG. 2 shows a regular hexagonal arrangement of transmitter cells. An arrangement of transmitter coils 21 is shown; the coils being positioned in hexagonal areas 22 as indicated by thin dotted lines. The size of the power surface constituted by the coils is predetermined, and can be selected by extending the surface in the vertical or horizontal directions as indicated by vertical dots 23 and horizontal dots 24. In such predetermined regular arrangements like FIGS. 1 and 2 the shape of the individual coils can be adapted to the arrangement, e.g. square shape for a square arrangement and hexagonal shape for a hexagonal arrangement. But also round coils can well be used, which makes the design calculation simpler. Such a regular, predetermined arrangement using the described coils shapes is known in the art, see e.g. U.S. Pat. No. 7,576,514.

Figure 8:
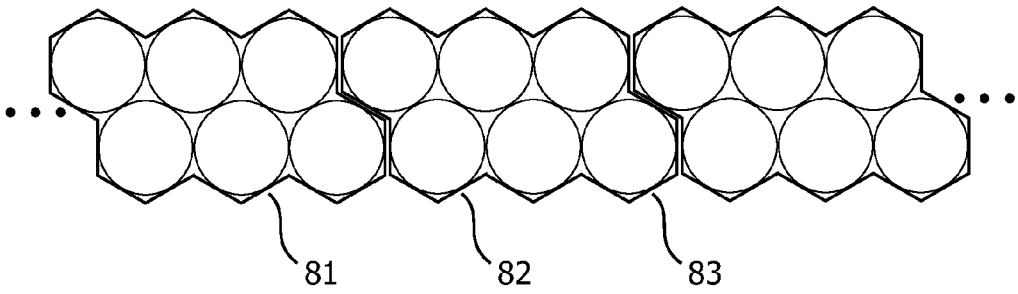
FIG. 8 shows a narrow stripe-shape power surface of six-coil modules.

Furthermore, it is noted that US 2009/0096413A1, in paragraph [0157] with reference to FIG. 8, describes an example of a modular power pad. The rectangular pads are connected in one direction to allow multiple devices to be powered. However, such a string of pads does not constitute an uninterrupted, extendible power surface. Moreover, the pads are separate units that need a central communications and storage unit, and cannot operate autonomously.

Figure 3:
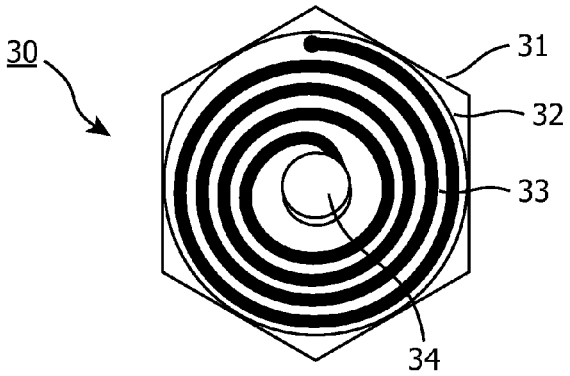
FIG. 3 shows a transmitter cell in a hexagonal shape.

FIG. 3 shows a transmitter cell in a hexagonal shape. The transmitter cell 30 is shaped according to a regular polygon, in the Fig. a hexagon 31. The transmitter cell comprises a transmitter coil 33 and may in addition comprise electronics 34, e.g. control circuitry at the backside of a panel carrying the coil. The area of the coil has been indicated by a coil border 32.

The circuitry may comprise a sensor for the presence detection and electronics to generate or control the current in the coil. The electronics is usually located on the backside of the coil 33 to provide a flat surface to the receiver. The transmitter cell has an outer shape which is related to the type of coil arrangement. The cells may be arranged in a hexagonal arrangement, but the shape of the coil can be round as illustrated in FIG. 3.

For providing a modular system having an arbitrarily extendible power surface, the transmitter cells are arranged in transmitter modules. The transmitter module has an outer periphery shaped so as to fit to neighboring transmitter modules for forming a power transmitting surface, the at least one transmitter cell is arranged within the outer periphery of the transmitter modules such that the power transmitting surface is constituted by an uninterrupted pattern of adjacent transmitter coils extending in said surface. For enabling the modules to operate as a continuous power surface, the transmitter module has interconnection units for connecting with neighboring transmitter modules for sharing a power supply.

A transmitter module may consist of a single transmitter cell. But preferably several cells are combined in one module. This way, control electronics (e.g. microprocessor, communication) are shared by the cells, which reduces the effort for electronics. The size of the module is a trade-off between modularity and effort reduction.

The transmitter module is conceived to provide a regular pattern of transmitter coils without a gap between individual modules, i.e. an uninterrupted pattern. Preferably, each module consists of more than one transmitter coil to reduce the effort for the control of the modules as elucidated below. To achieve a seamless area, the outer periphery of the transmitter module has to fit to the out periphery of the neighboring transmitter modules, and the transmitter cells should be arranged in an uninterrupted way within the transmitter module and the outer periphery of the module should be arranged such that when it is connected with the neighboring transmitter module, the two adjacent transmitter coils in different transmitter modules follows the same coil arrangement with that of the transmitter module, i.e the adjacent transmitter coils between neighboring modules should also in an uninterrupted way.

If the outer edge of the transmitter cells follows the outer periphery pattern of the module, the outer periphery of the module may be constituted by part of the out edge of the transmitter cells. For a quadratic arrangement, the module shapes follow the square shape of the cells. A hexagonal coil arrangement makes a much more sophisticated module shape possible.

Figure 4:
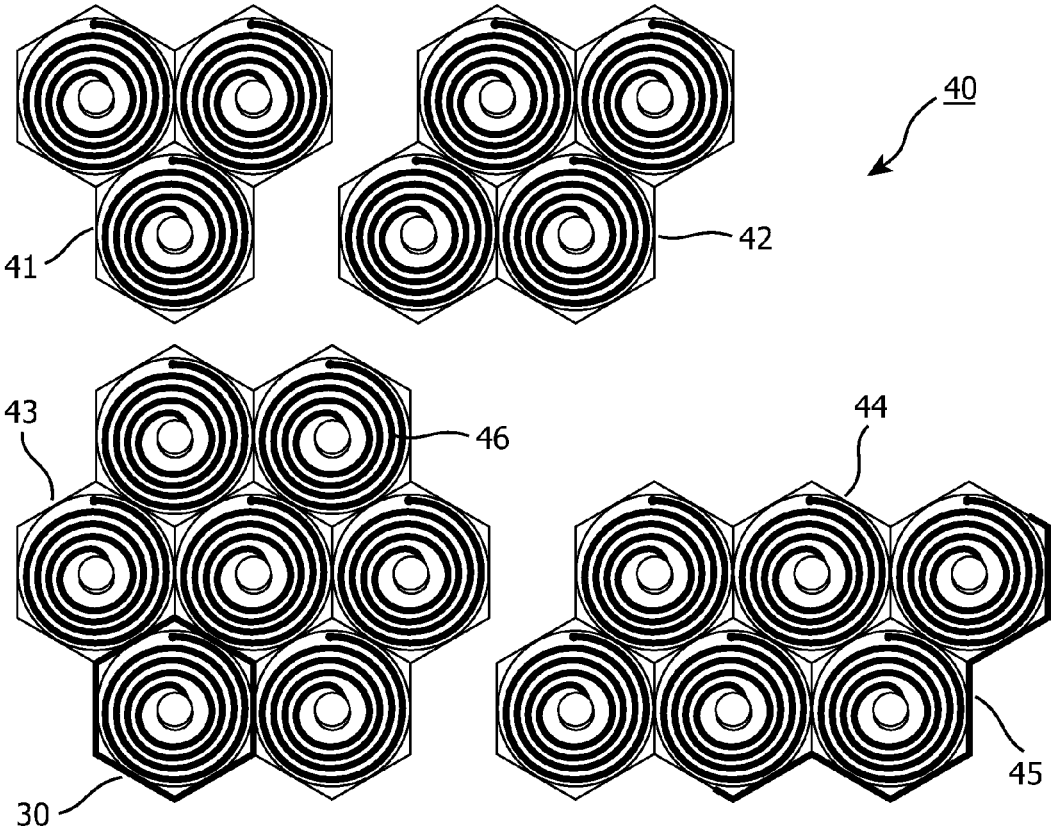
FIG. 4 shows transmitter modules based on a hexagonal transmitter cell.

FIG. 4 shows transmitter modules 40 based on a hexagonal transmitter cell. In one of the examples the transmitter cell 30 is indicated schematically by a broadened line; each transmitter cell having a transmitter coil 46. A first example of the transmitter module 41 has three hexagonal transmitter cells. A second example 42 has four hexagonal transmitter cells. A third example 43 has seven hexagonal transmitter cells. A fourth example 44 has six hexagonal transmitter cells. Each module has an outer periphery 45, in one example module indicated schematically by a broadened line, which periphery is constituted by parts of the cells at the boundary of the module. The following figures show how these modules can be combined to create larger areas of the power surface.

Figure 5:
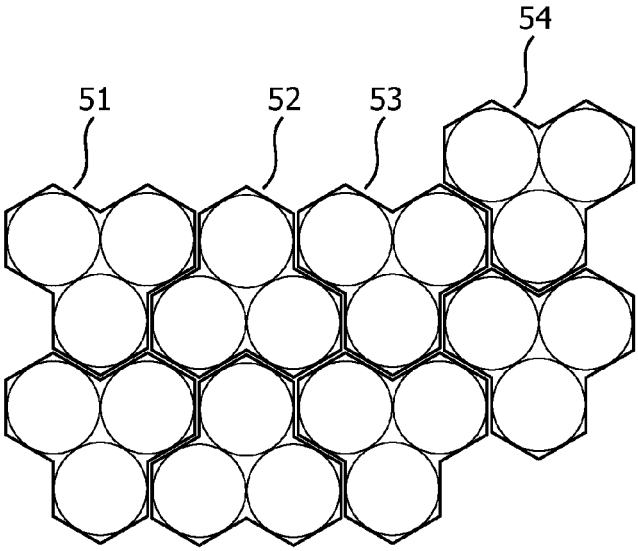
FIG. 5 shows a power surface of three-coil modules.

FIG. 5 shows a power transmitting surface of three-coil modules. A first transmitter module 51 is adjacent to a second module 52. A third transmitter module 53 is adjacent to a second module 52 again complementary oriented, followed by a fourth module 54. The pattern is arbitrarily extendible in different directions.

Figure 6:
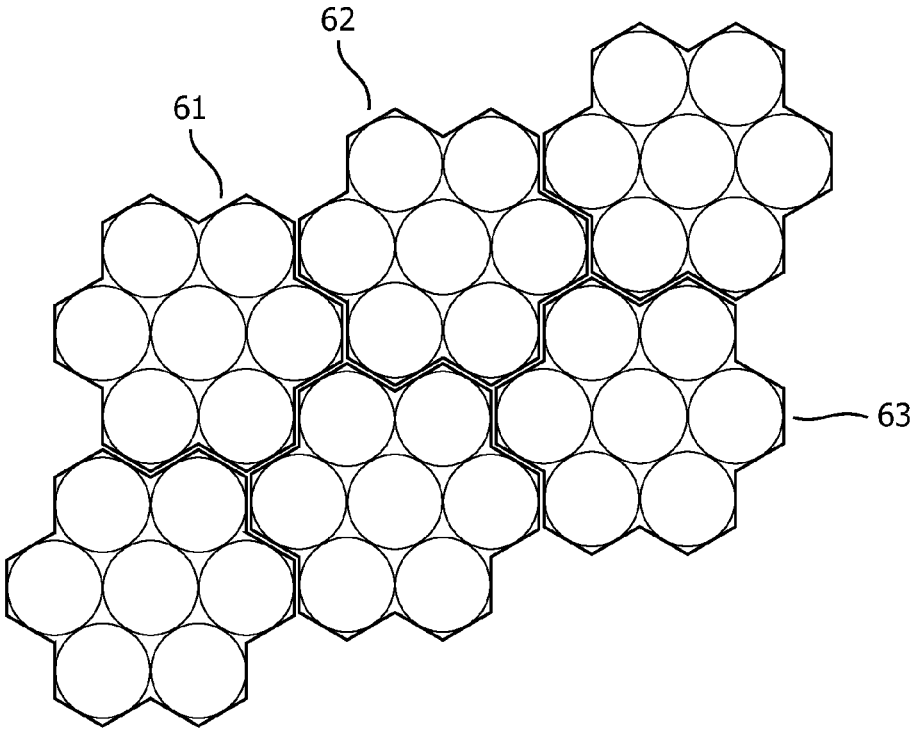
FIG. 6 shows a power surface of seven-coil modules.

FIG. 6 shows a power surface of seven-coil modules. A first transmitter module 61 is adjacent to a second module 62. A third module 63 is showing extending the pattern in a different direction.

Figure 7:
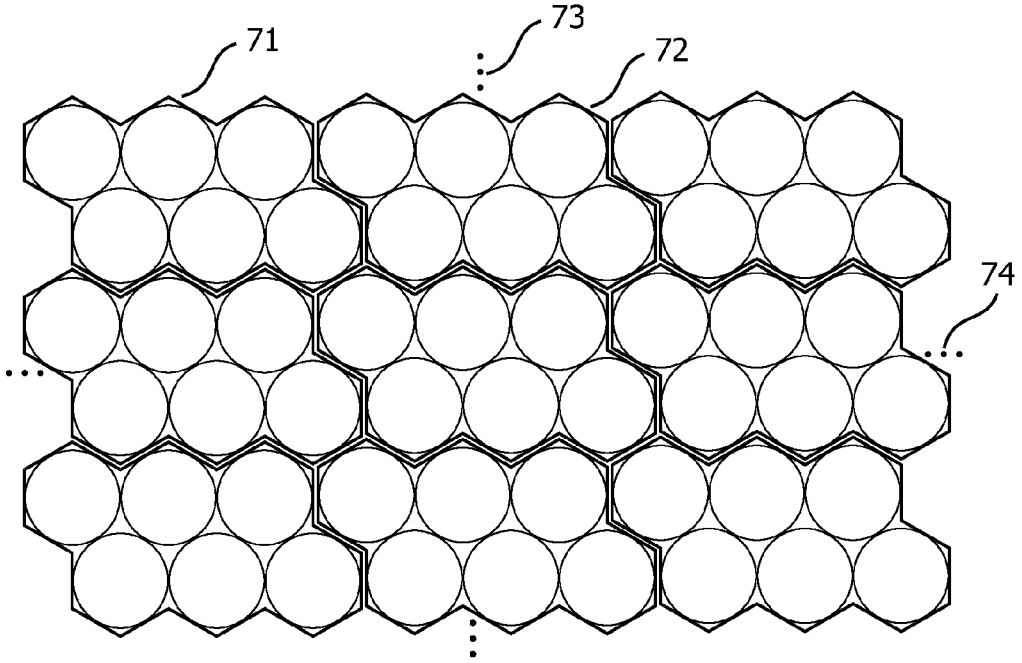
FIG. 7 shows a power surface of six-coil modules.

FIG. 7 shows a power surface of six-coil modules. A first transmitter module 71 is adjacent to a second module 72. Further modules allow extending the pattern in different directions shown by vertical dots 73 and horizontal dots 74.

FIG. 8 shows a narrow stripe-shape power surface of six-coil modules. The modules 81,82,83 are linearly arranged for constituting a narrow stripe shaped power surface.

Figure 9:
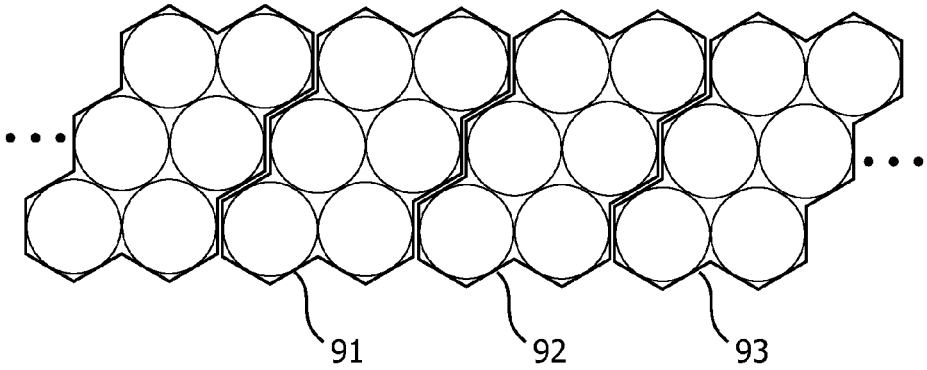
FIG. 9 shows a wide stripe-shape power surface of six-coil modules.

FIG. 9 shows a wide stripe-shape power surface of six-coil modules. The modules 91,92,93 are linearly arranged for constituting a stripe shaped power surface, wider than the arrangement of FIG. 8.

Also a combination of different module shapes is possible (not shown in a figure), as long as they relate to the same coil arrangement type.

To achieve a reasonable power transmission independent of the receiver's position, the transmitter coils may have a smaller diameter than the receiver coil. It is preferred that on any arbitrary position at least one transmitter coil is completely covered by the receiver.

Figure 10A:
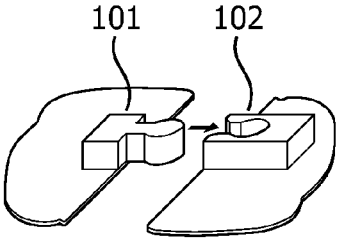
FIG. 10 shows a mechanical fixing layout.
Figure 10B:
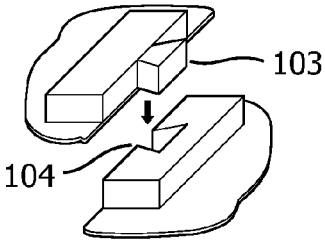

FIG. 10 shows a mechanical fixing layout. FIG. 10*a* shows a snap-in fixing, and FIG. 10*b* shows a dovetail fixing. The transmitter module as described above may have the outer periphery further provided with an extending part 101,103 at a first periphery position for connecting with a complementary cut-out part 102,104 at a second periphery position in the outer periphery of the neighboring transmitter modules, such as the examples in FIG. 10. When the module is arranged in the power transmitting surface, the first position is adjacent to the second position of a neighboring module. Subsequently a mechanical fixing is provided via the extending part and the cut-out part.

A further task of the transmitter module is to provide a suitable electrical interconnection between neighboring modules. The connection is needed for connecting a supply voltage from module to module. In an embodiment further communication signals are provided to the neighbored module, and other common signals. Details about the signals are provided in later. The interconnection units should allow a maximum degree of freedom to combine the modules. Preferably they prohibit a false interconnection, i.e. avoiding that different signals are connected to each other.

Various mechanical layouts are made available. A preferred mechanical layout of the interconnection between modules is to use contact pins and sockets, because this construction typically provides a reliable contact. This layout also provides some basic mechanical fixing.

Figure 11A:
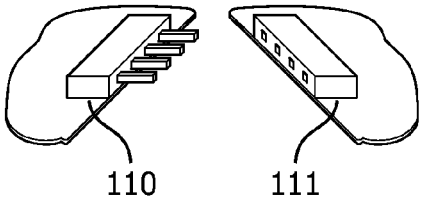
FIG. 11 shows a mechanical connector layout with horizontal pins.
Figure 11B:
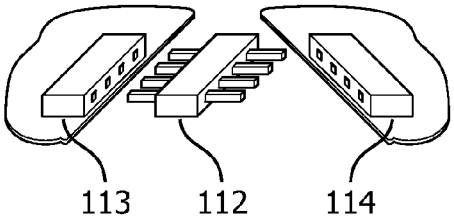

FIG. 11 shows a mechanical connector layout with horizontal pins. FIG. 11*a* shows a male connector 110 that belongs to the transmitter module for connecting with a female connector 111 that belongs to the neighboring transmitter modules. FIG. 11*b* shows two female connector plugs 113,114 for connecting with female connectors in the neighboring transmitter module via a male interconnector 112, which also provides some basic mechanical fixing. The pins and sockets are arranged in a horizontal way, such that the modules must be stuck together in the horizontal plane.

As an advantage of the male-female solution as indicated in FIG. 11*a*, it is inherently reverse-connection safe. As a disadvantage of this solution two kinds of connectors are needed. This limits the possibility to interconnect the modules arbitrarily. Furthermore, the pins of the male connector extend over the outer edge of the module. If the connector is on an outer edge of the power transmission area and not used, it limits the arrangement, because the module cannot be placed close to an edge.

A different solution is shown in FIG. 11*b*. Here, the module comprises only female connectors. To connect two modules, an interconnector with pins is used. As an advantage, all connectors in the module can be of the same type, which allows a high degree of freedom for the module arrangement. Furthermore, unused connectors don't extend over the edge of the module. As a disadvantage, the connectors are not inherently reverse-connection safe. The pin assignment must be selected accordingly. As a minor disadvantage, additional interconnector parts are necessary. As an advantage of the horizontal pin connectors, the building height can be very low. As a disadvantage, it is impossible to remove or exchange a single module out of a larger area. To achieve this, the whole area has to be de-mounted. Furthermore, it is impossible to mount certain shapes of modules.

In an embodiment, to allow the mounting of arbitrarily shaped modules in an arbitrary order, connectors with vertical pins are provided.

Figure 12A:
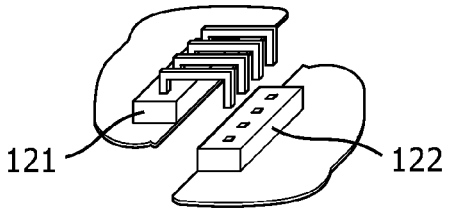
FIG. 12 shows examples of a mechanical connector layout with vertical pins.

FIG. 12 shows examples of a mechanical connector layout with vertical pins. FIG. 12*a* shows an arrangement with a male and a female connector.

Figure 12B:
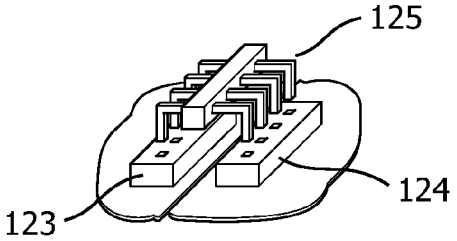

FIG. 12*b* shows an arrangement with two vertical female pins and a male interconnector. Both arrangements have similar advantages and disadvantages as the related arrangement with horizontal pins. A further possibility is to use contact springs instead of pins. Then, mechanical fixings must provide the force to hold the modules together. As an advantage, the contacts don't extend significantly over the edge of the module and modules can be mounted easily.

In the transmitter modules, when the modules are arranged in the power transmitting surface, the interconnection units are configured as shown above. The configuration may be male and female connectors, for connecting with female and male connectors in the neighboring transmitter module, the male pins being parallel to the power surface; female connectors, for connecting with female connectors in the neighboring transmitter module via interconnector pins parallel to the power surface; male and female connectors, for connecting with female and male connectors in the neighboring transmitter module, the male pins being perpendicular to the power surface; female connectors, for connecting with female connectors in the neighboring transmitter module via interconnector pins perpendicular to the power surface; or connectors, at opposite positions, having contact areas connectable via contact springs.

In the transmitter modules, when the modules are arranged in the power transmitting surface, the interconnection units may have various electrical configurations as follows. In an embodiment the connections are arranged along the periphery at a first periphery position and complementary connections of the neighboring transmitter modules at a second periphery position, the first and second positions matching when the modules are arranged as intended and not matching when the modules are arranged otherwise, for providing a reverse connection safety.

Figure 13A:
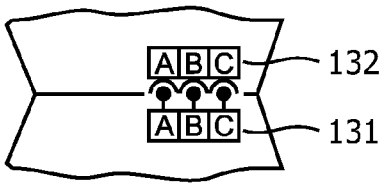
FIG. 13 shows an electrical layout and positioning of the interconnection units.

FIG. 13 shows an electrical layout and positioning of the interconnection units. FIG. 13*a* shows a combination with a male connector 131 and a female connector 132. They are inherently reverse-connection safe. In addition, the connectors are placed un-symmetrically with respect to the centre of the facing edges of the module. As illustrated later with FIG. 17, two connectors, which must not connect to each other, do not face each other.

Figure 13B:
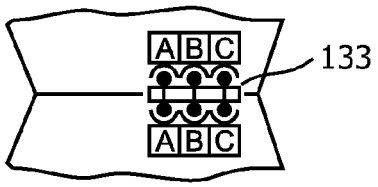

FIG. 13*b* shows an arrangement with two female connectors and a male interconnector 133. The pin assignment is not symmetrical. Therefore, two different pin assignments are necessary. To achieve reverse-connection safety the connectors are placed un-symmetrically with respect to the centre of the facing edges of the module. This way, two connectors, which must not connect to each other, do not face each other, similar to the case illustrated in FIG. 17.

FIG. 14 shows an electrical connector layout with reverse connection safety by a symmetrical pin assignment. The right symmetry is achieved, if the connector can be rotated by 180° in the plane and the rotated connector fits in the original one. The pin assignment, indicated by A,B,C, must have a mirror-symmetry with respect to the middle of the connector to achieve this. As a disadvantage, all signals (except the middle one) must be routed to two pins, which require larger connectors.

Figure 14A:
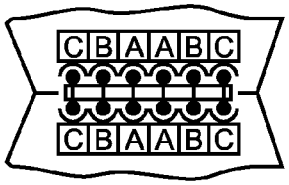
FIG. 14 shows an electrical connector layout with reverse connection safety by a symmetrical pin assignment.
Figure 14B:
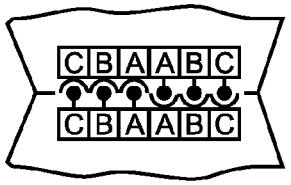

FIG. 14*a* shows the solution with two female connectors and an interconnector. FIG. 14*b* shows a hybrid solution, where some contacts of one connector are male and others are female. Due to the rotational symmetry, they can be arbitrarily combined. Such a hybrid solution uses horizontal pins. In this arrangement, the right pins face each other and any combination of connectors is allowed. Therefore, the connector is placed symmetrically with respect to the centre of the facing edges of the module. The connector layouts apply connections arranged along the periphery and have duplicate pins with respect to a centered position, the centered positions matching when the modules are arranged in the power surface.

Figure 15:
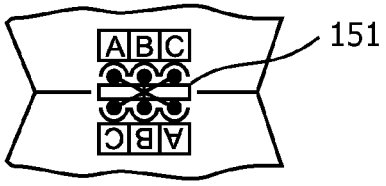
FIG. 15 shows an electrical connector layout with two female connector plugs and a male crossed-wire interconnector.

FIG. 15 shows an electrical connector layout with two female connector plugs and a male crossed-wire interconnector. The connections require a crossed-wire interconnector 151 between the interconnection units.

A further option to achieve symmetric connectors is to use coaxial connectors. Examples are headphone connectors (available with 4 pins or more) or coaxial power connectors. The coaxial connections may be used arranged along the periphery at a centered position, the centered positions matching when the modules are arranged in the power surface. Also connections arranged stacked perpendicularly to the power surface at a centered position are possible, the centered positions matching when the modules are arranged in the power surface.

To allow a most flexible arrangement of the modules, preferably each module has one connector on each edge, where it might face a neighbored module. Depending on the type of connector, it is place centered or off-centered to this edge as explained above. Not necessarily all of these connectors need be used in a final arrangement. If two different types of connectors or pin assignments are used, the module is divided along a symmetry axis. On one side of the symmetry axis the first type of connector is used, on the other side the second type of connector.

Figure 16:
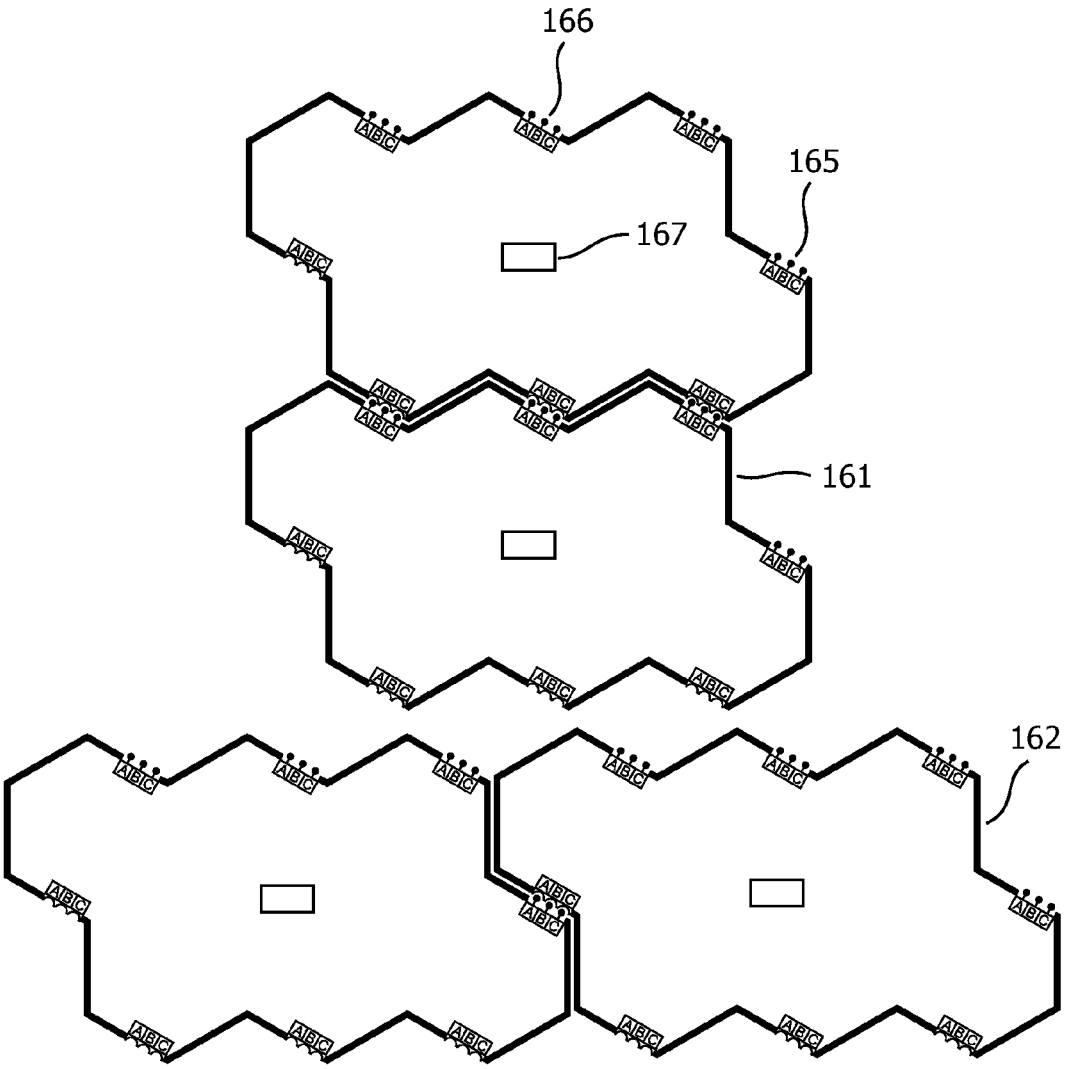
FIG. 16 shows interconnection of modules with correct orientation.

FIG. 16 shows interconnection of modules with correct orientation. The Fig. provides an interconnection example of contact location and the interconnection for the hexagonal six coil module. Two kinds of connectors are used. A symmetry line can be drawn horizontally. The figure shows two possible arrangements, a vertical arrangement 161 and a horizontal arrangement 162. The Figure further shows interconnection units 165,166 for connecting the modules in two directions, and a controller 167 on each module for controlling the power transfer functions of the module and other tasks as elucidated below.

Figure 17:
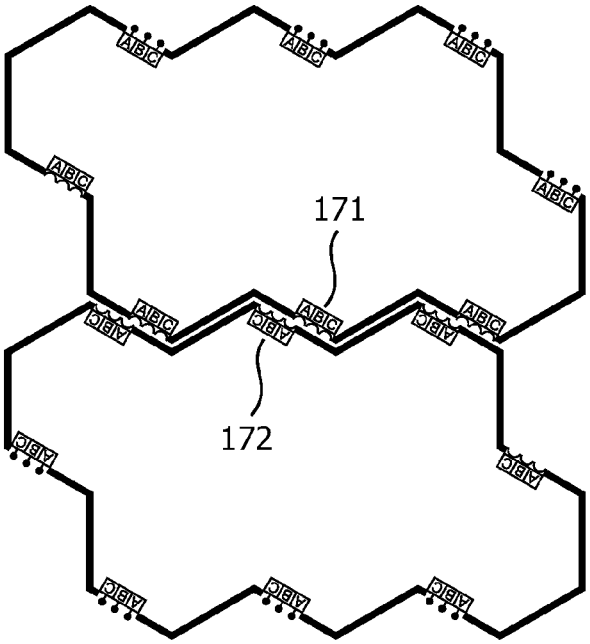
FIG. 17 shows reverse connection safety.

FIG. 17 shows reverse connection safety. In the example the modules have wrong orientation for interconnection. In an attempt to connect two modules at wrong sides the connectors 171, 172 don't fit to each other and a false connection is avoided.

In a further embodiment (not shown), each module comprises one central connector and all modules are connected by a flat cable using this connector.

The modules may have means to keep neighboring modules mechanically tiled together. For example, this may be a "click" or "snap-in" connection as shown in FIG. 10*a*. The fixing means may be combined with the electrical connector. Also a "lock" connection is possible, as e.g. known from flat ribbon cable connectors. A further exemplary means is a dovetail connection as shown in FIG. 10*b*, which can be used with an electrical connector with vertical pins as shown in FIG. 12. Also a mechanical interconnector is possible, e.g. an interconnector with two dovetails. Advantageously, it can be combined with an electrical connector with horizontal pins to improve the mechanical fixing.

The system can be provided with filler modules. The filler module has at least one outer periphery part being shaped so as to fit in at least one direction to neighboring transmitter modules forming the power transmitting surface. Thereto, the outer periphery part, where it is neighboring the transmitter modules, is shaped according to the outer periphery of the neighboring transmitter modules. The filler module has at least one further periphery part, the further periphery part, where it is not neighboring the transmitter modules, being straight for proving a straight boundary to the power surface.

The filler module may have a reduced electronic function, or no electronic function. These modules can be used to fill gaps for a homogeneous area, for interconnections between local active areas, to straighten the edge of an area, or to extend the active area effectively. It may happen that only a part of a surface (e.g. a floor, wall, ceiling or the like) is to be provided with wireless power transmission function. The remaining part of this surface is then not covered and the resulting surface not flat. To achieve a homogeneous flat surface, the "holes" may be filled with appropriate "dummy" modules without electronic function. The outer shape of the modules is adapted to the shape of the active modules. In the simplest case, they have the same shape.

Figure 18:
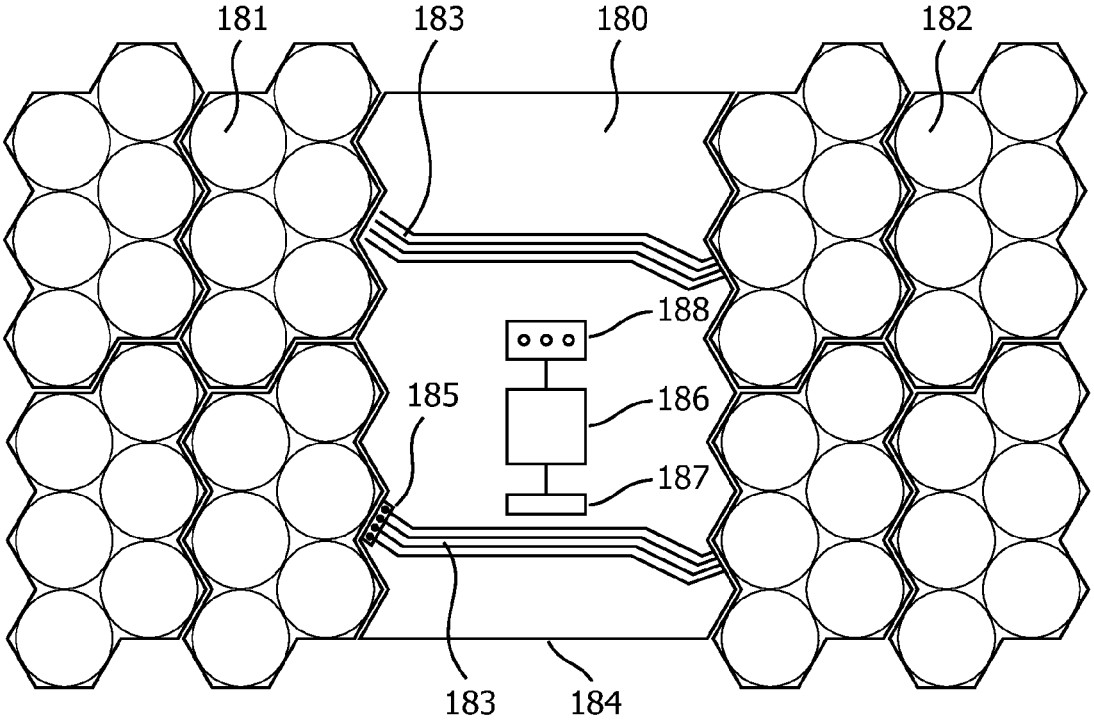
FIG. 18 shows a power surface having two active areas with six-coil modules connected with a filler module.

FIG. 18 shows a power surface having two active areas with six-coil modules connected with an extension module 180. The power surface has a two (or more) separated active areas 181,182 on the same surface. In an embodiment, to connect these areas, a filler module is inserted between the transmitter modules. The filler module provides electrical connection between the active areas. The filler module may have the same shape and connectors as transmitter modules. If the transmitter modules don't have straight edges, dummy modules can be used to straighten the edge of an area.

In a further embodiment, the extension module 180 is provided with components for constituting a central control unit. Thereto the extension module has interconnection units 185 for providing a power supply to neighboring transmitter modules. Furthermore, the extension module may have a system controller 186 for controlling power transfer or communication across different transmitter modules, and/or an operational interface 188 for enabling control of power transfer or communication across different transmitter modules, and/or a data interface 187 for enabling data transfer or communication across different transmitter modules or the receiver. The operational interface may be provided with user interface elements like buttons and/or a display.

Figure 19:
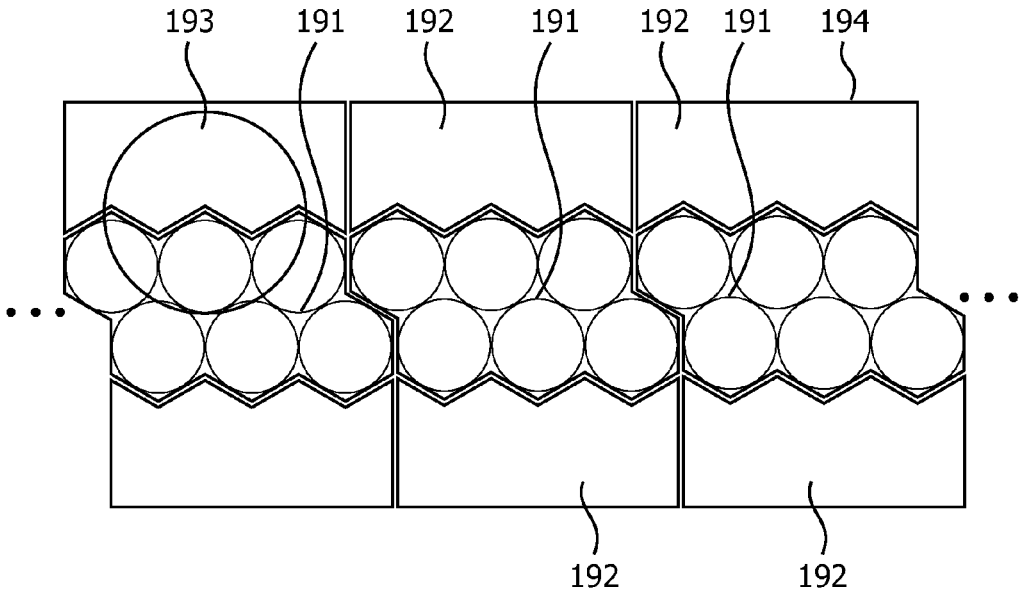
FIG. 19 shows a stripe area of six-coil modules and filler modules.

FIG. 19 shows a stripe area of six-coil modules and filler modules. A stripe shaped power surface is constituted by transmitter modules 191. At the outer boundary, filler modules 192 are positioned, having a straight outer periphery 194. A receiver 193 is shown adjacent to the power surface.

The dummy modules may also comprise a soft-magnetic layer, similar to the transmitter or receiver modules, as elucidated below. In the filler module, the soft-magnetic layer can be used to provide magnetic attraction of a receiver. This is advantageous for edge filler modules, as illustrated in FIG. 19. The transmitter can still be fixed, even if only a part of it overlaps with a transmitter coil. This way, the effective active area can be extended without effort.

Figure 20:
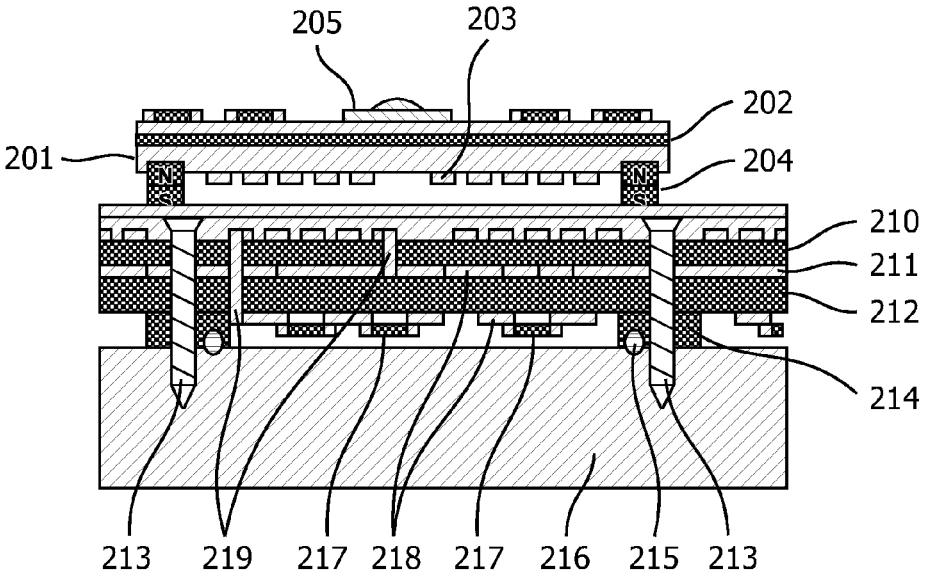
FIG. 20 shows a cross-section of a transmitter module and a receiver.

FIG. 20 shows a cross-section of a transmitter module and a receiver. The Figure illustrates the vertical built-up of the system, when the receiver is placed on the transmitter. The dimensions in the figure are not to scale; especially the vertical dimension is enhanced over the horizontal dimension. A receiver carrier 201 is made from a rigid material, e.g. printed circuit board (PCB) material. On the side facing to the transmitter the receiver winding 203 representing the receiver coil of the receiver is located. It may consist of copper wires, or from structured copper layers, which are laminated to the PCB. At the side of the winding permanent magnets 204 are attached, e.g. by gluing. The permanent magnets are attracted by a soft-magnetic layer of the transmitter (see below), such that the receiver is fixed to the transmitter. In a different embodiment, a permanent magnet is mounted in the centre of the coil (not shown). On top of the carrier electronic components may be located, e.g. to rectify the alternating voltage of the receiver. In this embodiment a target device 205, e.g. a lamp or light emitting diode (LED), is directly attached to the carrier. The lamp may also be connected to the carrier with additional mechanical means. In this exemplary embodiment, the receiver contains an additional soft-magnetic layer 202 to shield the alternating magnetic fields from the electronic circuit to prevent malfunction and the space above the receiver to prevent excessive emission of magnetic fields.

FIG. 20 also shows an exemplary embodiment of a transmitter. It comprises of a soft-magnetic sheet 210, a filler and adhesive layer 211, and a printed circuit board 212. The module may be fixed to a wall 216 using a fixation like screws 213, a spacer 214 and a sealing 215. The magnetic sheet consists of a material, which has low losses when subjected to alternating magnetic fields, e.g. Ferrite. Since it is difficult to achieve large, thin sheets made from Ferrite, the sheet can be made from single tiles placed close together. A preferred material is Ferrite Polymer Compound (FPC). FPC consists of Ferrite powder mixed in a plastic matrix. Such a material can easily be manufactured in large areas and can even be designed to be compatible to a PCB manufacturing process such that it can be treated like a layer of a multilayer PCB, as described in European patent application EP03101991.2. To achieve a reasonable function, the soft-magnetic layer has a thickness of about 1 mm or more. On top of the magnetic sheet, the windings of the transmitter coils are placed. The winding may be a thin, planar spiral winding. The windings can be made from conducting wire or made from structured copper layers, which are laminated to the soft-magnetic sheet. The transmitter may consist of more than one transmitter coil, which are placed closely side-by-side, as indicated in the figure by parts of neighboring coils on the sides.

The transmitter module comprises a controller 217 and other electronic components located at the backside of the printed circuit board 212 as shown in the figure. The components may also be placed on the side of the system or behind the soft-magnetic sheet. The transmitter can be covered with a protection layer. This protection layer is preferably made from PCB material and advantageously smoothens the surface of the transmitter. This protecting layer can also have a decorative function, e.g. like ceramic tiles or wooden floor tiles. An additional decorative function has an optional cover layer. This cover layer can be a thin layer of paint, printed decorative foil, wall paper, thin wood, thin plaster or a floor covering like PCV tiles or carpet. The thin, smoothing cover layer allows a magnetic fixation even on top of transmitter coils.

The driving electronics may be located on the backside of the soft-magnetic sheet using an additional PCB fixed to the soft-magnetic layer, e.g. by lamination. An additional PCB may be attached to the backside, if necessary. The interconnections of the PCB are connected to the transmitter coils by electrically conducting vias 219. The vias are insulated from the soft-magnetic sheet, if necessary (not shown). On the PCB, electrical components are attached, which form the driving, control and communication circuits of the transmitters. In order to prevent mechanical pressure on the electronic devices on the backside, spacers 214 are added to provide a sufficient distance. The spacers need not only be at the positions of the screws (as shown in the figure) but can also be arranged as excess surrounding the electronic circuit. An optional sealing can then be used to protect the electronic circuit from environmental impact.

The whole arrangement can be fixed to the wall, ceiling or floor by fixation means 213, e.g. one or two holes for screws or nails. The fixations can be covered after mounting with the cover layer to make the system invisible. It can also be something like a hook and eye arrangement on the backside of the module. The fixing must not extend outside the outer shape of the module.

To provide a better coupling homogeneity, especially for small receivers, an additional layer of transmitter coils can overlap the first layer. To achieve an overlapping of coils in neighbored modules with a flat surface of the whole area, the modules must have a step-shape profile to overlap.

In an embodiment the transmitter module has a first layer of transmitter cells and a further layer of transmitter cells. The transmitter coils of the further layer are overlapping at least two transmitter coils of the first layer, so as to provide a more homogeneous magnetic field for the inductive power transfer to the receiver. More than two layers of transmitter cells are also possible. In the transmitter module the outer periphery may further be provided with a step-shape profile, the further layer extending beyond the first layer at a part of the periphery. When arranging such transmitter modules in the power surface, the extending further layer part of one module is fitted under a complementary extending part of the first layer.

With respect to providing power to the transmitter coils, each module may have its own generator. Then each cell also comprises an electronic switch to control the transmission of this cell. A more flexible solution is to provide a generator for each cell. A generator may have two switching elements (e.g. transistors) in a halve-bridge arrangement. Different arrangements are also possible, as known in the art. Each module may comprise additional power converters to provide auxiliary voltages for the control circuits.

A supply voltage is to be provided to the transmitter modules, usually a DC supply. Hence the power supply is shared between the modules. The related pins of the connectors are connected in parallel. The power voltage may be provided by a central power supply. It may be advantageous to provide separate supply voltages for the power transmission and for the control circuitry. The supply voltage for the power transmission may also be an AC voltage.

In an embodiment, in the transmitter module the interconnection units are arranged for providing a communication connection between said neighboring transmitter modules. The controller and further electronic components may be provided for communication and providing further control signal to neighboring modules. In particular, the interconnection units may be arranged for providing at least two separate power supply signals as described above. Furthermore, electrical signals may be provided for accommodating a common communication bus, a local communication bus, a virtual common communication bus, a connected module sense signal, a synchronization signal, and/or any other suitable communication or control signal.

In an embodiment digital communication via a communication bus is provided. In a first exemplary embodiment, all modules share a common communication bus. The related pins at the connectors are connected in parallel and the bus is connected to the controller of the module. Preferably, it uses serial data communication. Several standards exist, which can be used, e.g. RS485. Known method to deal with anti-collision can be used, e.g. arbitrary delay of reactions.

An optional master controller or a remote control may make use of this bus to control individual modules or all modules in common. As an advantage, this embodiment needs only one communication port per controller and all modules are interconnected to each other. However, communication speed may be low, if a high number of modules are combined and are communicating. Furthermore, the common bus system has practical limits in the number of modules that can be connected, and if one module is malfunctioning and shows erroneous behavior towards the bus, the whole communication system may fall down.

In a further embodiment, local communication busses are provided. A local communication bus is a straight connection only between two neighbored modules. From one controller, to each neighbor an individual communication line exists. Advantageously, it is a series connection, e.g. RS232 or simply digital lines with TTL level or lower. Advantageously, the communication speed is high, because the modules don't influence each other. An error in one local connection does not directly influence the rest of the system. The complete system can still be in communication although a link between two modules is broken. The communication system can become more robust against errors in the communication links. However, communication is possible only with the next neighbors.

In a further embodiment a virtual common communication bus is provided. To combine high communication speed and global communication, both a common bus and local busses are implemented. Local busses may be combined to a common communication bus on demand. In a first solution, each module has a means to physically connect all local busses. The resulting bus behaves similar as the described common communication bus. The change between local bus and common bus can be related to phases of operation. E.g. during the first phase of commissioning (see below), the busses are in local operation mode and after that change to common operation.

In an embodiment a possibility to "broadcast" a command is provided setting the operation mode of the busses. The local busses may be used as a common bus to "broadcast" commands. If a module or a master controller wants to communicate to all modules in the area, it sends a special command preceding the message. If the neighbored module receives this command, it will send the same message to all other connected modules. A module may receive the same message a second time by a different neighbor. In this case, the message is not sent further. This way the message spreads among the whole area. Thus, the local busses are virtually connected to constitute a virtual common communication bus.

In a further embodiment each module has a local routing table which can be build up during determining the position and orientation of the transmitter module with respect to the other transmitter modules. When a module wants to communicate to another module, it sends a message out containing the identifier of the module. The routing table of each module contains a connection port for each message ID. If the module has to communicate a message to another module, or if a module has to forward a message to another module, it looks up the appropriate connection port to which it has to send the message in the routing table. In this way the message find its way from the source module to the destination module. To make the communication system robust, each module may store an additional alternative connection port for each message ID. In case the communication link of a preferred connection port is not functioning, the module can choose the alternative connection port to route the message.

In an embodiment a connected module sense signal is provided. Each plug may have a sense signal, which indicates that a neighbored module is connected to this plug.

In an embodiment a static module sense signal is provided, e.g. a digital line input connected to the pin of the corresponding connector. As one example, this line is pulled to high potential with a pull-up resistor. The related pin of the neighbored connector is connected to ground level (GND). If the two modules are connected with these connectors, the line is pulled down and the controller knows that this connector is connected to a neighbored module. The pin assignment must be symmetric, such that both modules know about the connection.

In an embodiment a dynamic module sense signal is provided. Now the line is not shorted, but two lines, which relate to the corresponding connectors, are connected. Each of the two controllers can read the state of this line and can set its level. E.g. each controller has open-collector output to pull down the line and the line is set to high level by a pull up resistor during non-active state. The pin assignment must be symmetric, such that the two corresponding lines are connected.

In an embodiment, to synchronize the power transmission of neighbored modules, a power clock signal is provided to be shared by the modules. The signal has the same frequency of the power transmission. The power generator is synchronized to this signal. This way, the phase shift of the alternating magnetic fields of neighbored modules can be controlled to keep it constant and or to minimize it. This may be necessary, if e.g. a larger power receiver needs the power transmission of more than one transmitter and if the power receiver covers transmitter cells of two or more neighbored modules. The power clock signal can be provided by a central power supply or a central master controller. In another embodiment, the power clock signal is generated by the related communication master.

In an embodiment, each transmitter module can operate autarkic. Thereto the transmitter module comprises a controller to autonomously control the transmitter cells, e.g. a microprocessor with a non-volatile memory. All modules may have the same level of hierarchy, and are arranged to organize themselves, as described in the following paragraphs.

The controllers of the modules are able to communicate to each other. Each transmitter module may have a unique identifier (ID), e.g. a number code. The ID may be provided by the manufacturer. In a different example, the IDs are negotiated between all involved modules, e.g. by the order in which they are assembled together. The ID is stored in the non-volatile memory. The cells in each module may have successive numbers, such that each transmitter cell can be addressed individually. Combining the module ID and the cell number gives a unique identifier for each individual cell.

In an embodiment the transmitter module comprises a memory for storing identification information. In particular, the identification information may comprise identification information for identifying the transmitter module, when the module is arranged in the power surface. Furthermore, the identification information may comprise transmitter cell addressing information for identifying each transmitter cell, when the module is arranged in the power surface. Additionally, the identification information may comprise type information for identifying the transmitter module type, when the module is arranged in the power surface. The controller is arranged for transferring the identification information between different transmitter modules arranged in the power surface.

In an embodiment the controller of the transmitter module is arranged for determining its position and orientation relative to the other modules. For most applications it is sufficient to know about the immediate adjacent modules and their orientation. More precise, each module knows the neighbored cells to each own cell. This information may be obtained on a special request, e.g. during or immediately after the assembly of the wireless power area. Then this information is stored in the non-volatile memory. The determination of this information is called commissioning. The following methods are examples for obtaining the commissioning.

In an embodiment manual determining the position and orientation of the transmitter module with respect to other transmitter modules is accommodated. A special control device with user interface can read the ID of a module. Furthermore, this control device has a user interface, which allows grouping the modules virtually. Before assembly, the user must read the ID of each module. Then the modules are virtually placed in the user interface on the position, where they finally will be located. Finally, the control device sends the entered position information to all modules. As an advantage, this method doesn't need local intelligence for determining the position and orientation of the transmitter modules. Furthermore, one global communication bus structure is sufficient for this kind of application. Manual setting the position and orientation of the transmitter modules is very flexible, but it requires an effort of the user who assembles the modules, and errors may easily happen.

In an embodiment determining the position and orientation information during the connection is accommodated, i.e. to do the determination during the assembly of a power surface. It requires at least a static sense signal for connected modules at each plug (see above) and an assembly during power on for at least the control circuit ("hot plug in"). If the new module is attached to the existing area, it sends its ID over the communication channel. The neighbored module, to which it is attached, registers on the related plug that a module is connected. Since the new module has sent its ID, the neighbored module can attribute the signal from the connector to the correct module ID. This way, the determination can be done successively.

In an embodiment determining with signaling to neighbor is accommodated. A sense line is connected from each plug to the controller of the module to provide a dynamic module sense signal, as described above. After the power surface is assembled, the determination procedure is started on a special event, e.g. immediately after power on or after a command of a master controller via the common communication line. Then, successively each module transmits its ID on the common communication bus while activating all sense lines to its connectors. Neighbored modules can recognize the activation of the sense lines to their own connectors. They can now relate the activation to the module which sent its ID and thus now their neighbor.

In a further embodiment, each connector can be attributed to individual cells (possibly allowing more than one connector per cell) and the module activates the lines to the connectors one after the other, while it transmits the cell number via the common communication bus. This way, the neighbored module can identify not only the neighbored module, but the exact location of neighbored cells. In a similar, but different method, each connector is related to one edge of the module. Then, neighbored modules can determine the orientation of the active module. From this, the location of the individual cells can be derived.

To improve the reliability, the modules which detected a neighbor can acknowledge the detection using the common communication bus. The order of the module activation can e.g. be attributed to the ID numbers of the modules. The process ends after no further module puts its ID on the bus within a specified time (end by "time out"). In a different embodiment, prior to the determination, all modules in the area register in a special "round". Then, the number of modules is known and the commissioning needs no time-out.

After the detection process, each module knows its immediate neighbors. For most applications, this is sufficient, but for advanced applications it may be necessary for each module to know about the whole landscape of modules or at least a wider environment. Therefore, after the first determination round, all modules may exchange their information such that each module gets complete landscape information.

As an advantage, this method only needs one communication bus, while there are no high requirements on the signal lines to the neighbors.

In an embodiment determination with communication to neighbor is accommodated. Each connector provides individual digital communication from and to the controller by a local communication bus. If two modules are connected an exclusive digital communication channel between the two controllers is created. During the determination procedure each module sends its ID to its neighbor using these communication channels. This way, each module gets knowledge about its immediate neighbors. Similar as in the previous embodiment, each connector can be attributed to one edge or to one cell, such that neighbored modules can determine the orientation of the module. After the detection of the immediate neighbors, all modules may exchange their information such that each module gets complete landscape information. For this purpose, an additional common communication bus is used, or the local busses are physically or virtually connected to a virtual common communication bus. As an advantage, this method is faster than the sequential method with simple signaling to the neighbor. However as a disadvantage, it requires more communication lines per module.

In an embodiment the controller of the transmitter module is arranged for detecting a receiver. If a receiver is placed on the module, it may be detected by using any known method. Then, transmitter module and receiver communicate to each other. Beside other initialization information, the receiver identifies itself with a unique identifier (receiver ID). If the receiver is validated, the controller of the transmitter module sends a request to neighbored (or all) modules, if a receiver with the same identifier is detected elsewhere, too. If no further module has detected the same receiver, the module controller takes over the control of the power transmission. If further modules have detected the same receiver, the modules must coordinate control over the power transmission. One example for this is described in the following section.

In an embodiment, the controller is arranged for coordinating of power control between transmitter cells in different transmitter modules arranged in the power surface. To coordinate the power control if more than one module has detected the same receiver, one of the involved modules is assigned as "control master". A master controller is adapted to send control signal via said interconnection units, to other controllers in the other transmitter modules, so that the control signal is used by said other controllers for controlling the power transfer of the module they belongs to. Selecting the control master may be achieved based on detecting the transmitter cell with the best communication to the receiver (strongest signal, best Signal to Noise Ratio). Alternatively the first one which finds the receiver may take control. This control master takes over the control for this receiver. It manages the communication to the receiver and sets the power level of the appropriate cells. It may control cells of neighbored modules, if necessary. For this purpose, it communicates with the neighbored modules. It requests control of cells in the neighbored modules and the neighbored modules attribute these cells as "occupied". The control master then "dictates" the power level of the cells, and the controllers of the neighbored modules have to set the power level accordingly.

A master module can request to hand-over its master function to a neighbor module, which is preferably, but not exclusively the module at which a cell has detected a receiver. This feature is especially relevant in case a module might have to control cells for multiple receivers. By this feature control tasks can be distributed among the involved modules in order to prevent overloading a module with control tasks. This feature also allows to minimize the needed processing power per module and to optimize production cost for a module.

In an embodiment grouping the at least one transmitter cell with at least one other transmitter cells in a different transmitter module arranged in the power surface is accommodated. The grouping is done by the control master. After this grouping, the control master then can generate control signal to respective transmitter cells in one group.

In an embodiment communication is accommodated between the modules, if more than one transmitter cell is involved in the power transmission. Besides an overlapping receiver, as described in the previous section, further examples include negotiation about power transmission for multi-cell activation for larger receivers, far field compensation, or limitation of power transmission due to maximum power restrictions, e.g. if more than one receiver needs power.

Finally, in an embodiment, the system is provided with a central unit. The central unit may be used for the following tasks:

Coordinate. e.g. reset position detection, act as control master.

Human interface (on-off switch, remote control)

Manage application data transfer

It is to be noted that the invention may be implemented in hardware and/or software, using programmable components. It will be appreciated that the above description for clarity has described embodiments of the invention with reference to different components, functional units and processors. However, it will be apparent that any suitable distribution of functionality between different functional units or processors may be used without deviating from the invention. For example, functionality illustrated to be performed by separate units, processors or controllers may be performed by the same processor or controllers. Hence, references to specific functional units are only to be seen as references to suitable means for providing the described functionality rather than indicative of a strict logical or physical structure or organization.

A modular power transmitting system comprises multiple transmitter modules is introduced in the present invention. The transmitter module proposed in this invention is for use in a system. The system comprises multiple transmitter module connected together for transmitting power inductively to a receiver. Preferably, the each of the transmitter modules has the same coil arrangement as well as outer periphery arrangement. Each of the module comprises at least one transmitter cell, each transmitter cell having one transmitter coil by which the transmitter cell transmitting power to the receiver, the transmitter module having an outer periphery being shaped so as to fit to neighboring transmitter modules for forming a power transmitting surface, the outer periphery being further shaped such that the power transmitting surface is constituted by an uninterrupted pattern of adjacent transmitter coils extending in said surface, and interconnection units (110,111) for connecting with neighboring transmitter modules for sharing a power supply. Such system has an uninterrupted coil arrangement.

Although the present invention has been described in connection with some embodiments, it is not intended to be limited to the specific form set forth herein. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An arrangement of transmitter modules, each transmitter module being arranged for being connected with other transmitter modules for transmitting power inductively to a receiver, wherein a transmitter module of the arrangement of transmitter modules comprises:

at least one transmitter cell, each transmitter cell having one transmitter coil by which the transmitter cell transmitting power to the receiver, the transmitter module having an outer periphery being shaped so as to fit to neighboring transmitter modules for forming a power transmitting surface, the at least one transmitter cell being arranged such that the power transmitting surface is constituted by an uninterrupted pattern of adjacent transmitter coils extending in said surface, and interconnection units for connecting with neighboring transmitter modules for sharing a power supply, wherein the outer periphery of the transmitter module is shaped according to part of an outer periphery of a regular hexagon.

2. The arrangement of transmitter modules as claimed in claim 1, wherein transmitter module comprises a first layer of transmitter cells and at least one further layer of transmitter cells, a transmitter coil of the further layer overlapping at least two transmitter coils of the first layer.

3. The arrangement of transmitter modules as claimed in claim 2, wherein the outer periphery is further provided with a step-shape profile, the further layer extending beyond the first layer at a part of the periphery.

4. The arrangement of transmitter modules as claimed in claim 1, wherein the outer periphery of the transmitter module is further provided with an extending part at a first periphery position and a complementary cut-out part at a second periphery position, and, the first position being adjacent to the second position of a neighboring module for providing a mechanical fixing via the extending part and the cut-out part.

5. The arrangement of transmitter modules as claimed in claim 1, wherein the interconnection units, have a configuration comprising at least one of:

male connectors, for connecting with female connectors in the neighboring transmitter module, the male pins being parallel to the power surface;

female connectors, for connecting with male connectors in the neighboring transmitter module, or for connecting with female connectors in the neighboring transmitter module via interconnector pins parallel to the power surface;

male connectors, for connecting with female connectors in the neighboring transmitter module, the male pins being perpendicular to the power surface;

female connectors, for connecting with male connectors in the neighboring transmitter module, or for connecting with female connectors in the neighboring transmitter module via interconnector pins perpendicular to the power surface;

connectors, having contact areas connectable via contact springs.

6. The arrangement of transmitter modules as claimed in claim 1, wherein the interconnection units, have a electrical configuration comprising at least one of:

connections arranged along the periphery at a first periphery position and complementary connections of the neighboring transmitter modules at a second periphery position, the first and second positions matching when the modules are arranged as intended and not matching when the modules are arranged otherwise, for providing a reverse connection safety;

connections arranged along the periphery and being duplicate with respect to a centered position, the centered positions matching with the centered positions at the neighboring transmitter modules when the modules are arranged in the power surface;

connections comprising crossed-wire interconnectors between the interconnection units;

coaxial connections arranged along the periphery at a centered position, the centered positions matching when the modules are arranged in the power surface;

connections arranged stacked perpendicularly to the power surface at a centered position, the centered positions matching when the modules are arranged in the power surface.

7. The arrangement of transmitter modules as claimed in claim 1, wherein the interconnection units are arranged for providing a communication connection between the transmitter module and the other transmitter modules.

8. The arrangement of transmitter modules as claimed in claim 7, wherein the interconnection units are arranged for connections comprising at least one of:

at least two separate power supply signals;

a common communication bus;

a local communication bus;

a virtual common communication bus;

a connected module sense signal;

a synchronization signal.

9. The arrangement of transmitter modules as claimed in claim 1, wherein the transmitter module further comprise a controller for controlling transmitting power from said transmitter module to the receiver, the controller is arranged for at least one of:

coordinating of power control between transmitter cells in different transmitter modules arranged in the power surface;

determining position and orientation of the transmitter module with respect to other transmitter modules arranged in the power surface;

grouping at least transmitter cell with at least one other transmitter cells in a different transmitter module arranged in the power surface;

detecting a receiver positioned across different transmitter modules arranged in the power surface.

10. The arrangement of transmitter modules as claimed in claim 9, wherein the transmitter module comprises a memory for storing at least one of:

identification information for identifying the transmitter module;

transmitter cell addressing information for identifying each transmitter cell;

type information for identifying the transmitter module type; and wherein the controller is arranged for transferring, via the interconnection units, at least one of above information among different transmitter modules arranged in the power surface.

11. The arrangement of transmitter modules as claimed in claim 9, wherein the controller is arranged for determining a position and orientation of the transmitter module with respect to other transmitter modules arranged in the power surface by at least one of:

receiving position and orientation information via a control device having a user interface;

detecting at least one control signal of a neighboring transmitter module during the connection of the transmitter modules;

communicating to a master controller of the system;

communicating to neighboring transmitter modules.

12. The arrangement of transmitter modules as claimed in claim 1, further comprising a filler module, the filler module having at least one outer periphery part being shaped so as to fit in at least one direction to neighboring transmitter modules forming the transmitting power surface, the outer periphery part, where it is neighboring the transmitter modules, being shaped according to the outer periphery of the neighboring transmitter modules, and at least one further periphery part, the further periphery part, where it is not neighboring the transmitter modules, being straight for proving a straight boundary to the power surface.

13. The arrangement of transmitter modules as claimed in claim 1, further comprising an extension module, the extension module having at least one outer periphery part being shaped so as to fit in at least one direction to neighboring transmitter modules forming the power transmitting surface, the outer periphery part, where it is neighboring the transmitter modules, being shaped according to the outer periphery of the neighboring transmitter modules, and wherein the extension module comprises interconnection units for providing a power supply to neighboring transmitter modules, or a system controller for controlling power transfer or communication across different transmitter modules; or an operational interface for enabling control of power transfer or communication across different transmitter modules; or a data interface for enabling data transfer or communication across different transmitter modules or the receiver.

14. A modular power transmitting system comprising an arrangement of transmitter modules being connected for transmitting power inductively to a receiver, wherein a transmitter module of the arrangement of transmitter modules comprises:

at least one transmitter cell, each transmitter cell having one transmitter coil by which the transmitter cell transmitting power to the receiver, the transmitter module having an outer periphery being shaped so as to fit to neighboring transmitter modules for forming a power transmitting surface, the at least one transmitter cell being arranged such that the power transmitting surface is constituted by an uninterrupted pattern of adjacent transmitter coils extending in said surface, and interconnection units for connecting with neighboring transmitter modules for sharing a power supply, wherein the outer periphery of the transmitter module is shaped according to part of an outer periphery of a regular hexagon.

15. The modular power transmitting system as claimed in claim 14, wherein transmitter module comprises a first layer of transmitter cells and at least one further layer of transmitter cells, a transmitter coil of the further layer overlapping at least two transmitter coils of the first layer.

16. The modular power transmitting system as claimed in claim 15, wherein the outer periphery is further provided with a step-shape profile, the further layer extending beyond the first layer at a part of the periphery.

* * * * *